US005983846A

United States Patent [19]

Klöpfer

[11] Patent Number: 5,983,846

[45] Date of Patent: Nov. 16, 1999

[54] TWO-STROKE ENGINE FOR A PORTABLE HANDHELD WORK APPARATUS

[75] Inventor: Karl-Heinz Klöpfer, Winnenden, Germany

[73] Assignee: Andreas Stihl AG & Co., Waiblingen, Germany

[21] Appl. No.: 09/094,398

[22] Filed: Jun. 10, 1998

[30] Foreign Application Priority Data

Jun. 11, 1997 [DE] Germany ..... 197 24 580

[51] Int. Cl.[6] ..... F02B 33/04; F02F 7/00

[52] U.S. Cl. ..... 123/73 PP; 123/73 A; 123/195 H

[58] Field of Search ..... 123/73 R, 73 A, 123/73 PP, 65 R, 195 C, 195 H, 195 R

[56] References Cited

U.S. PATENT DOCUMENTS

| | | | |
|---|---|---|---|
| 2,959,164 | 11/1960 | Janeway et al. | 123/73 A |
| 4,109,622 | 8/1978 | Fujikawa et al. | 123/73 PP |
| 4,934,345 | 6/1990 | Fukuoka et al. | 123/73 PP |
| 4,958,602 | 9/1990 | Hoppner et al. | 123/195 H |

FOREIGN PATENT DOCUMENTS 3222457 12/1982 Germany .

*Primary Examiner*—Willis R. Wolfe
*Assistant Examiner*—Brian Hairston
*Attorney, Agent, or Firm*—Walter Ottesen

[57] ABSTRACT

The invention is directed to a two-stroke engine for a portable handheld work apparatus such as a motor-driven chain saw. The engine includes a cylinder housing and a crankshaft journalled in shaft bearings. The cylinder housing is closed by a crankcase cover. Half shells are formed in the cylinder housing and the crankcase cover to accommodate the shaft bearings. Overflow channels are formed in the wall of the cylinder and lead from the crankcase to the combustion chamber. The overflow channels are open at their ends facing toward the crankcase cover and interrupt the support surface of the half shells formed in the cylinder housing. An adequate support of a small crankshaft bearing is ensured for an arrangement of several overflow channels. This is achieved in that the half shells are configured with a significantly larger diameter than the outer diameter of the shaft bearing and a support shell is seated in the free space between the half shell and the shaft bearing. The support shells close the gaps in the support surface of the half shells.

11 Claims, 2 Drawing Sheets

TWO-STROKE ENGINE FOR A PORTABLE HANDHELD WORK APPARATUS

FIELD OF THE INVENTION

The invention relates to a two-stroke engine for a portable handheld work apparatus such as for a motor-driven chain saw, brushcutter, cutoff machine or the like.

BACKGROUND OF THE INVENTION

A two-stroke engine of this kind is disclosed in German Patent 3,222,457. The cylinder housing includes a cylinder having a crankcase half which is formed as one piece on the foot of the cylinder. The crankcase half is closed with a crankcase cover secured with threaded fasteners. On mutually opposite sides of the crankcase, a crankshaft is journalled in shaft bearings and, for this purpose, half shells are formed in the cylinder housing and the crankcase cover. The half shells formed in the cylinder housing for accommodating the shaft bearing are interrupted with respect to their supporting surfaces by overflow channels which lead from the crankcase into the combustion chamber and are open at their ends toward the crankcase cover. The interrupted supporting surface of the half shell in the cylinder housing can lead to an inadequate support of the shaft bearing so that the shaft bearing tends to deform ovally under load causing bearing wear to be very substantial. The half shells support the shaft bearing.

More critical exhaust-gas requirements mandate an optimization of the purging and the charging of the combustion chamber and, for this purpose, the number of overflow channels is increased. Because of the increased number of overflow channels, the support surface of the half shell accommodating the shaft bearing in the cylinder housing is further reduced. In order to still ensure an adequate support of the shaft bearing, the diameter and therefore the diameter of the half shell is increased. This not only leads to increased weight but to an overall increased structural size because the crankcase cover must be configured larger in order to take the larger shaft bearing into account. In addition, larger shaft bearings have a lower maximum permissible rpm and this leads to problems at the high rpms of the two-stroke engines used in portable handheld work apparatus.

SUMMARY OF THE INVENTION

It is an object of the invention to provide a two-stroke engine which is so improved that the installation of shaft bearings small in diameter is possible with adequate support in the cylinder housing having an increased number of overflow channels.

The two-stroke internal combustion engine of the invention is for a portable handheld work apparatus including a chain saw, brushcutter, cutoff machine and the like. The two-stroke engine drives a crankshaft and includes: a cylinder housing having a cylinder wall delimiting a combustion chamber at a first end portion and having a second end portion; a crankcase cover attached to the cylinder housing so as to close off the second end portion; the crankcase cover and the second end portion conjointly defining a crankcase for accommodating the crankshaft; a shaft bearing for rotatably journalling the crankshaft; a first half shell formed in the second end portion and a second half shell formed in the crankcase cover and the first and second half shells conjointly defining a receptacle for accommodating the shaft bearing therein; a plurality of internal overflow channels formed in the cylinder so as to extend from the crankcase to the combustion chamber; the first half shell defining a supporting surface facing toward the shaft bearing; the overflow channels having ends open to the crankcase and interrupting the supporting surface of the first half shell so as to form gaps therein; the first half shell having a diameter (H) substantially greater than the outer diameter (W) of the shaft bearing whereby the supporting surface and the shaft bearing conjointly define a free space therebetween; and, a supporting shell seated in the free space so as to close the gaps and provide firm support for the shaft bearing.

To configure the half shell (for accommodating the shaft bearing) in the cylinder housing with a significantly larger diameter than the outer diameter of the shaft bearing departs from the conventional teaching of configuring the half shell facing the housing only so large that a play-free accommodation of the bearing to be seated is ensured. In the invention, a free space is formed between the shaft bearing and the half shell by the larger diameter. This free space serves to accommodate a support shell which closes the gaps in the support surface of the half shell caused by the overflow channels. Because of the larger diameter of the half shell, the support surface between two gaps is sufficiently large to ensure a reliable bracing of the support shell. On the other hand, the support shell is configured to be so thick that the free space is completely filled and a play-free support at the shaft bearing is thereby provided. The shaft bearing is sufficiently stiffly supported over the support shell in the cylinder housing so that an oval deformation of the shaft bearing is reliably precluded even under load. The bearing wear is lower and the service life of the bearing is increased.

The configuration provided by the invention further makes possible the use of bearings with small diameters having small roller elements. Accordingly, on the one hand, cost-effective light bearings can be used and, on the other hand, the bearings have an adequately high limit rpm which is clearly above the permissible maximum rpm of the two-stroke engine.

It is purposeful to hold the support shell axially in the cylinder housing in a form-tight manner so that an external radial collar is preferably provided which engages in a corresponding receiving slot in the cylinder housing.

The support shell is further secured by the assembled crankcase cover radially as well as in the direction of rotation so that the support shell lies anchored form tight and without play in the cylinder housing after mounting the crankcase cover.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
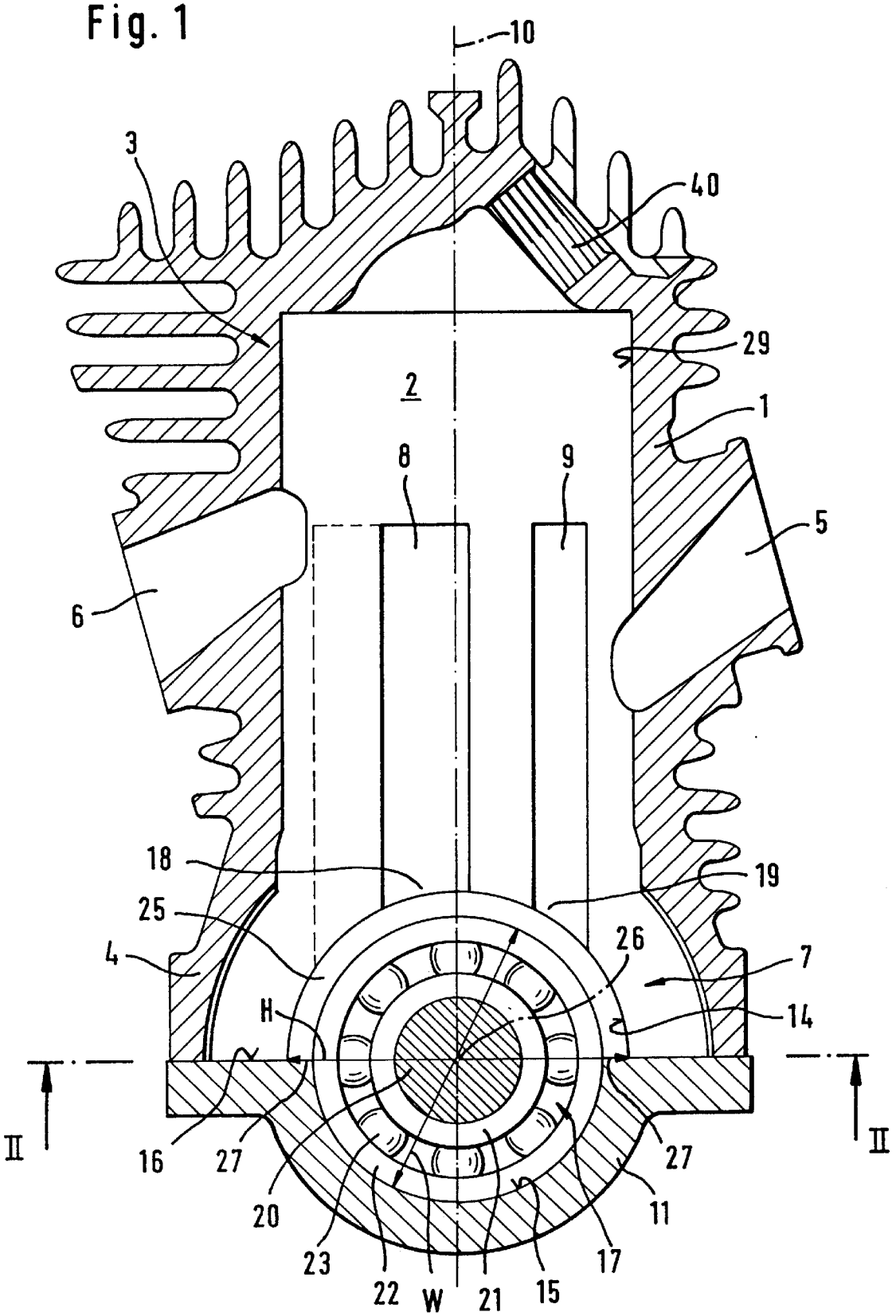
FIG. 1 is a side elevation view, in section, of a cylinder housing of a two-stroke engine with the cylinder housing being closed by a crankcase cover; and, FIG. 2 is a detail section view taken along line II—II of FIG. 1.

The cylinder housing shown in FIG. 1 is part of a two-stroke engine as used in portable handheld-work apparatus, such as motor-driven chain saws, brushcutters, cutoff machines or the like. The cylinder housing comprises essentially a preferably one-piece cylinder 3 having a crankcase half 4 cast as one piece therewith at its foot region. The cylinder 3 is ribbed for the purpose of air cooling and has an inlet 5 as well as an outlet 6. A combustion mixture is drawn by suction into the crankcase 7 via the inlet 5. Combustion gases are conducted away from the combustion chamber 2 via the outlet 6.

Overflow channels (8, 9) are formed in the bore wall of the cylinder bore 29 and extend in the direction of the cylinder longitudinal axis 10. The overflow channels (8, 9) start approximately at half elevation of the outlet 6 and extend as far as into the crankcase 7. The overflow channels (8, 9) are open over their entire length toward the cylinder longitudinal axis 10 as well as at their ends (18, 19) facing toward the crankcase 7.

At its end facing away from the crankcase 7, the cylinder bore 29 has a bore 40 in the region of the cylinder roof to accommodate a spark plug or the like in order to ignite the mixture in the combustion chamber 2 which is compressed by a piston (not shown). The control of the inlet 5, the outlet 6 as well as the overflow channels (8, 9) takes place via the piston reciprocating in the cylinder bore 29. The piston drives the crankshaft 20 in rotation in a manner known per se.

The cylinder housing 1 is provided with a crankcase cover 11 for closing the crankcase 7. The crankcase half 4 is configured as one piece with the cylinder 3 and the crankcase cover 11 is fastened with threaded fasteners to the crankcase half 4 so that it is in tight contact engagement therewith.

Figure 2:
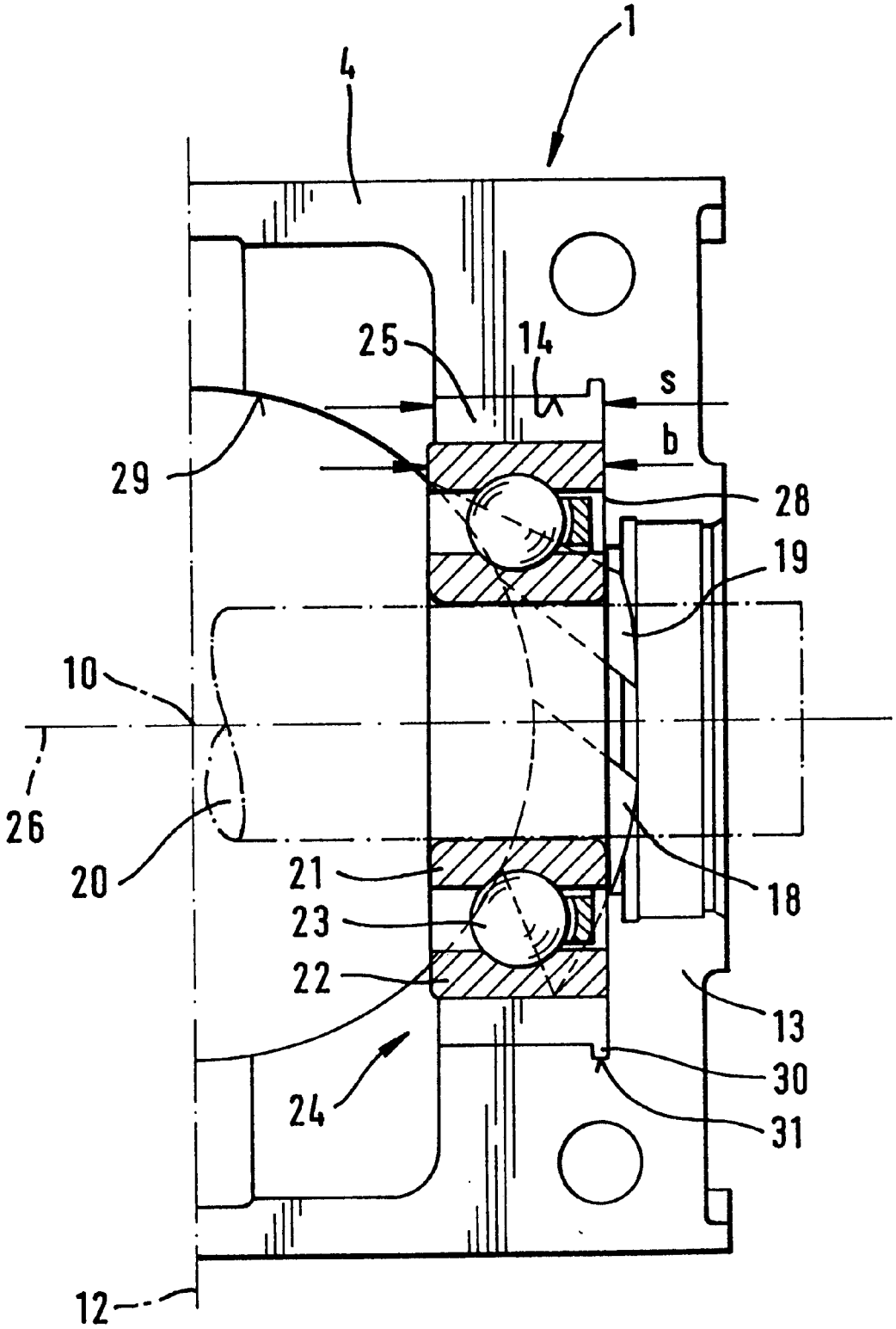

As shown in FIG. 2, the crankcase half 4 is symmetrical to a center axis 12 passing through the cylinder longitudinal axis 10 and has mutually adjacent side walls 13. The side walls 13 have respective receptacles configured as half shells 14 for accommodating shaft bearing 17. As shown in FIGS. 1 and 2, the half shell 14 lies in the region of the open ends 18 and 19 of the overflow channels. The open ends 18 and 19 of the overflow channels 8 and 9 interrupt the support surface of the bearing half shell 14.

A half shell 15, which corresponds to the bearing half shell 14, is formed in the crankcase cover 11. The partition plane 16 between the crankcase cover 11 and the crankcase half 4 of the cylinder housing 1 also defines the partition plane of the half shells 14 and 15.

The half shells 14 and 15 function to seat and support the crankshaft bearing 17 via which a crankshaft 20 is rotatably journalled in the crankcase 7. The shaft bearing 17 is held between the side walls 13 and comprises an inner race 21 and an outer race 22. Bearing elements 23 are held between the outer race 22 and the inner race 21. The inner race 21 supports the crankshaft 20; whereas, the outer race 22 is supported in the half shells 14 and 15.

To achieve a uniform support of the shaft bearing 17 in the cylinder housing 1, the half shell 14 in the cylinder housing 1 has a clearly larger diameter H than the outer diameter W of the shaft bearing 17. In this way, a free space 24 results between the shaft bearing 17 and the half shell 14 in the cylinder housing 1. This free space 24 serves to accommodate a support shell 25 which bridges the open ends 18 and 19 of the overflow channels 8 and 9, respectively, that is, the support shell 25 partially covers the overflow channels 8 and 9.

The support shell 25 has a width (s) measured in the direction of the crankshaft longitudinal axis 26. The width (s) corresponds approximately to the width (b) of the outer race 22 of the shaft bearing 17. The support shell 25 extends in the peripheral direction over the entire length of the half shell 14 and engages around the shaft bearing 17 over 180°. The ends 27 of the support shell 25 terminate at the partition plane 16 between the crankcase cover 11 and the cylinder housing 1. In this way, the support shell 25 is fixed against rotation in the peripheral direction of the shaft bearing 17 and is also radially secured.

The support shell 25 has a peripherally extending external collar 30 to axially secure the same. The collar 30 engages in a corresponding receiving slot 31 formed in the cylinder housing 1, that is, in the half shell 14. The receiving slot 31 lies at the edge 28 of the support surface of the half shell 14. The edge 28 faces away from the crankcase 7. The half shell 14 has an axial width which corresponds to the axial width (s) of the support shell 25. The support shell 25 is thereby held in the cylinder housing 1 over its entire axial width (s).

In the embodiment shown, the support shell 25 has a radial thickness which corresponds approximately to the radial thickness of the outer race 22 of the shaft bearing 17. The external race 22 is also surface supported in the region of the open ends 18 and 19 of the overflow channels 8 and 9, respectively, via the support shell 25. The shell 25 performs a bridging function in the region of the open ends 18 and 19. Furthermore, it can be seen in FIG. 2 that the cylinder bore 29 also projects into the half shell 14. Here too, the support shell 25 bridges the gap in the support surface formed by the cylinder bore 29. The shaft bearing is provided with adequate support and this is a condition precedent to a disturbance-free operation over a long service life.

The support shell 25 preferably lies within the seal of the crankcase 7 so that no further sealing is necessary because of the additional component, namely, the support shell 25.

Preferably, the support shell 25 is made of a material different from the material of the cylinder housing 1. The cylinder housing is preferably made of aluminum or a magnesium pressure casting. The support shell 25 is preferably made of steel. A sintered material, aluminum or even plastic can be adequate. The support shell 25 is manufactured especially so that it is unstressed, that is, the support shell 25 can be sintered, pressed or injected.

It is understood that the foregoing description is that of the preferred embodiments of the invention and that various changes and modifications may be made thereto without departing from the spirit and scope of the invention as defined in the appended claims.

What is claimed is:

1. A two-stroke internal combustion engine for a portable handheld work apparatus including a chain saw, brushcutter, cutoff machine and the like, the two-stroke engine driving a crankshaft and comprising:

a cylinder housing having a cylinder wall delimiting a combustion chamber at a first end portion and having a second end portion;

a crankcase cover attached to said cylinder housing so as to close off said second end portion;

said crankcase cover and said second end portion conjointly defining a crankcase for accommodating said crankshaft;

a shaft bearing for rotatably journalling said crankshaft;

a first half shell formed in said second end portion and a second half shell formed in said crankcase cover and said first and second half shells conjointly defining a receptacle for accommodating said shaft bearing therein;

a plurality of internal overflow channels formed in said cylinder so as to extend from said crankcase to said combustion chamber;

said first half shell defining a supporting surface facing toward said shaft bearing;

said overflow channels having ends open to said crankcase and interrupting said supporting surface of said first half shell so as to form gaps therein;

said first half shell having a diameter (H) substantially greater than said outer diameter (W) of said shaft bearing whereby said supporting surface and said shaft bearing conjointly define a free space therebetween; and, a supporting shell seated in said free space so as to close said gaps and provide firm support for said shaft bearing.

2. The two-stroke internal combustion engine of claim 1, wherein said support shell is held axially in a form-tight manner in said cylinder housing.

3. The two-stroke internal combustion engine of claim 1, said support shell having an outer collar formed thereon and said cylinder housing having a slot formed therein for receiving said outer collar.

4. The two-stroke internal combustion engine of claim 1, said crankcase cover being mounted on said cylinder housing so as to radially secure said support shell.

5. The two-stroke internal combustion engine of claim 1, further comprising sealing means for sealing said cylinder housing; and, said support shell being within said sealing means.

6. The two-stroke internal combustion engine of claim 1, wherein said support shell is made of a material different than the material of said cylinder housing.

7. The two-stroke internal combustion engine of claim 1, wherein said support shell is made of a material selected from the following: steel, aluminum, a sinter material or plastic.

8. The two-stroke internal combustion engine of claim 1, wherein said support shell is manufactured such that it is unstressed.

9. The two-stroke internal combustion engine of claim 8, wherein said support shell is made by sintering.

10. The two-stroke internal combustion engine of claim 8, wherein said support shell is made by pressing.

11. The two-stroke internal combustion engine of claim 8, wherein said support shell is made by injection.

* * * * *